United States Patent [19]

Hoyt

[11] Patent Number: 4,528,621

[45] Date of Patent: Jul. 9, 1985

[54] FLASHLIGHT

[76] Inventor: Robert Hoyt, 900 S. Edson St., Lombard, Ill. 60148

[21] Appl. No.: 586,062

[22] Filed: Mar. 5, 1984

[51] Int. Cl.[3] ..... F21L 7/00

[52] U.S. Cl. ..... 362/189; 200/60; 362/84; 362/205; 362/295

[58] Field of Search ..... 362/189, 84, 205, 295; 200/60

[56] References Cited

U.S. PATENT DOCUMENTS

| | | | |
|---|---|---|---|
| 3,449,558 | 6/1969 | Whitmer | 362/83 |
| 3,796,869 | 3/1974 | Stone | 362/189 X |
| 4,210,953 | 7/1980 | Stone | 362/189 |
| 4,242,724 | 12/1980 | Stone | 362/189 X |
| 4,419,718 | 12/1983 | Chabria | 362/189 X |

*Primary Examiner*—Stephen J. Lechert, Jr.

*Attorney, Agent, or Firm*—Fitch, Even, Tabin & Flannery

[57] ABSTRACT

A flashlight is disclosed with a housing having a flexible sidewall which is deformed onto a resiliently folded membrane switch to energize and light the flashlight. The flashlight may have a bulb cap at the end of the housing carrying the light bulb with phosphorescent material being molded into the bulb cap and activated by the use of the flashlight to produce a phosphorescent afterglow at the bulb cap.

5 Claims, 9 Drawing Figures

FLASHLIGHT

This invention relates to flashlights. More particularly this invention relates to small, inexpensive flashlights carried in the pocket or purse. Generally this type of flashlight includes a housing having a flexible wall, the housing enclosing a battery retaining case with cylindrical battery chambers in which a pair of batteries are enclosed. A lightbulb is carried at one end of the housing and includes lead wires from the bulb which are connected to the battery.

The switching mechanism used in conjunction with small flashlights should be durable, inexpensive, capable of being mass produced and easy to assemble. Heretofore flashlights, particularly in connection with small flashlights having a flexible housing which is pressed or squeezed causing the switching mechanism to activate the bulb with the flashlight batteries, have been subject to certain problems. The switching mechanisms usually have comprised wire extending over the retaining case for the batteries with the wire deforming and contacting the batteries when the housing is resiliently compressed. That type of mechanism is subject to undesirable metal fatique, will permanently deform and is expensive to manufacture and assemble. Frequently in a mechanism which has a deformable wire which serves as a part of a switching mechanism, the wire can be deformed causing the circuit to stay in a closed position thereby causing the flashlight to stay on and deplete the batteries activating the bulb.

U.S. Pat. No. 3,796,869 to Stone describes a small flashlight with a switching mechanism having a core in which a switch wire is inserted. The switch wire is resiliently deformed when the housing of the flashlight is squeezed or pressed. This engages the switch wire with the conductive surface of one of the batteries to complete the circuit to light the bulb.

U.S. Pat. No. 4,032,773 to Halliday et al. describes a flashlight similar to the one described by Stone, except the batteries are in a battery retaining member which includes resiliently deformable arcuate arms. A switch wire overlies the resiliently deformable battery retaining member. When the flexible housing is depressed or squeezed, the wire makes contact with a conductive surface of one of the batteries thereby activating the bulb.

U.S. Pat. No. 4,122,510 to Halliday describes a flashlight and switching mechanism similar to that described in U.S. Pat. No. 4,032,773. The number of parts in the switching mechanism have been reduced as compared to U.S. Pat. No. 4,032,773. Basically, however, a switching member comprising long and short metal legs overlies a resiliently deformable battery retaining member such that when the housing is squeezed the switching member will make contact with the conductive surface of the battery inserted within the battery retaining member.

It is characteristic in each of the described patents that the switching mechanism is made of numerous parts which have the proclivity to fatigue. The numerosity of the parts and their assemblage also increase the cost of the flashlight.

It is an object of this invention to provide a durable inexpensive small flashlight.

It is also an object of this invention to provide a small flashlight with an improved switching mechanism.

It is a further object of this invention to provide a flashlight which is inexpensive durable and easy to assemble.

Other objects and advantages of the invention will become apparent from the following detailed description taken in connection with the accompanying drawings, in which.

In accordance with the present invention I have found a durable, inexpensive, easy to assemble flashlight which comprises a housing having a flexible side wall adapted to be inwardly and resiliently flexibly deformed to energize and light said flashlight; a battery retaining case adapted to hold a pair of batteries in spaced relation; a light bulb having at least two electrical leads for electrical connection with the batteries; a membrane switch between said housing and said retaining case, said membrane switch connecting the contacts of said bulb with said batteries, said membrane switch including a first and second conductor bonded on a flexible substrate insulator strip, said conductors terminating in a first and second switch contact, said membrane switch being resiliently folded so that when the housing is flexibly deformed said first and second switch contacts are connected to energize said flashlight.

Figures 1, 2, 3:
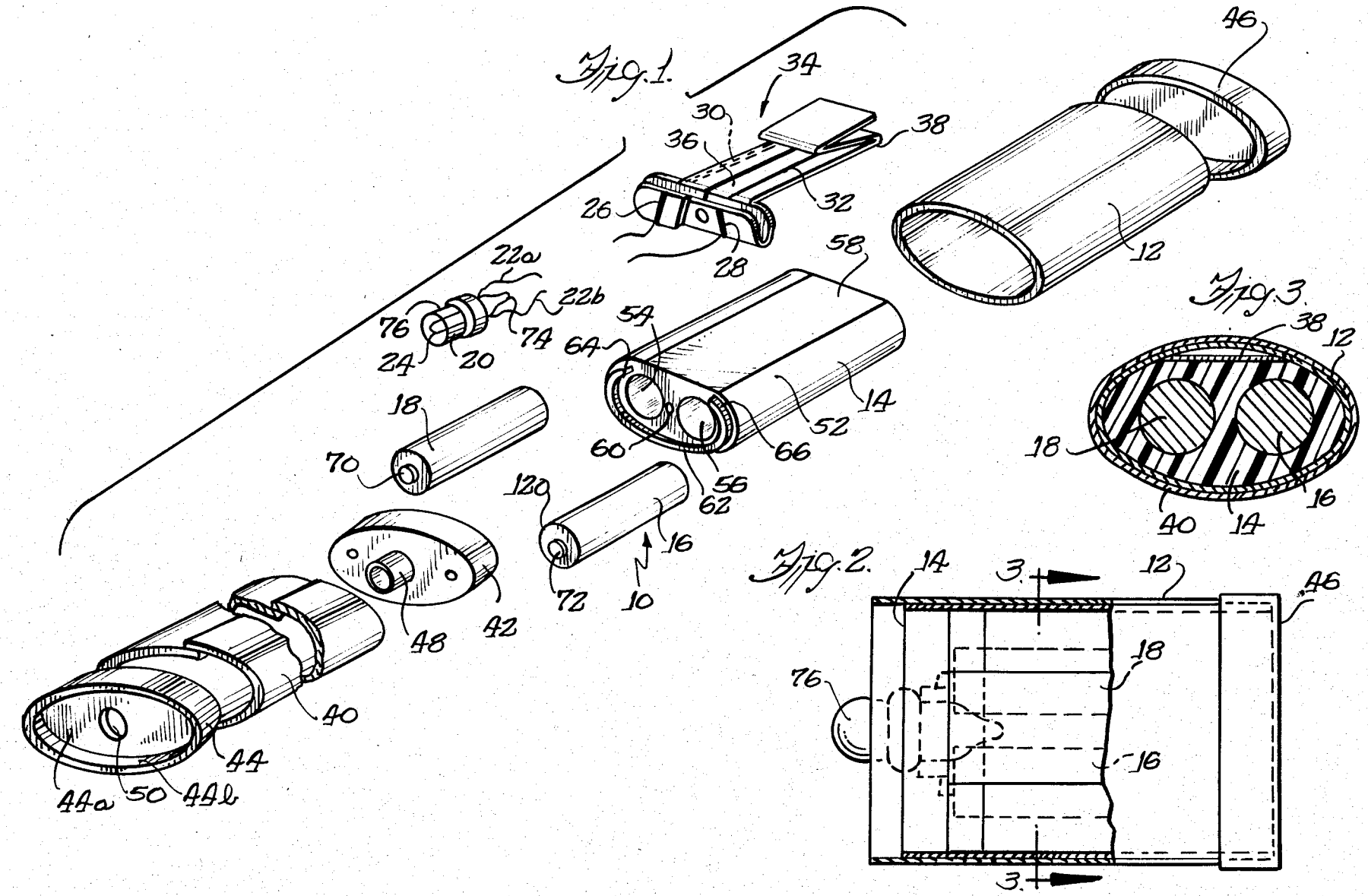
FIG. 1 is a perspective view of the flashlight in accordance with this invention.
FIG. 2 is a partial section view of the flashlight illustrated in FIG. 1 shown in assembled condition.
FIG. 3 is a sectional view of the flashlight along line 3—3 of FIG. 2.
Figure 4:
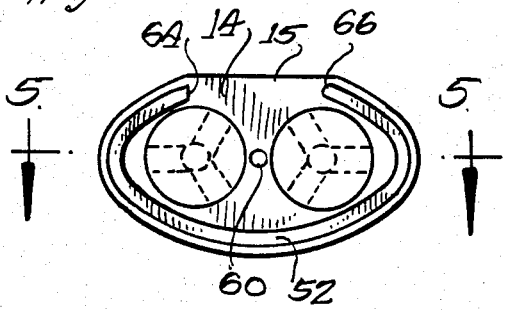
FIG. 4 is a partial sectional view of the flashlight illustrated in FIG. 1 with the housing omitted.

Referring to FIG. 1 there is illustrated a flashlight 10 comprising a housing with a generally flexible outer housing wall 12 with a battery retaining case 14 disposed therein. The battery retaining case holds batteries 16 and 18 in spaced relation. One end of the housing carries a lightbulb 20 including lead wires **22*a* and 22*b* extending from the filament 24 of the bulb into contact with a pair of light contacts 26 and 28 of conductors 30 and 32. A flexible membrane switch 34 includes the first and second conductor 30 and 32 respectively bonded onto a flexible substrate insulator 36 strip which forms switch body 38**. The membrane switch is resiliently folded and is inserted between the flexible outer housing wall and battery retaining case so that when the housing is flexibly deformed the first and second conductors will contact and energize the flashlight with the batteries.

As noted above the housing includes a generally flexible outer sidewall 12. The outer sidewall surrounds a flexible inner wall 40. Both walls are generally rectangular pieces of plastic, coated paper or some other similar flexible insulating material and are shaped to define a oval cross-sectional cavity. The outer wall member 12 is preferably transparent and the inner wall member 40 may be opaque and may include printing of any desired type such as for advertising. A bulb base 42 and a bulb cap 44 are fitted at one end of the oval cross-sectional cavity of the housing walls 12 and 40. A closure cap 46 is fitted at the opposing end of the oval cross-sectional cavity formed by the flexible walls 12 and 40. The bulb base is generally oval in cross-section and includes a cylindrical bulb shield 48 extending in the direction of the longitudinal axis of the oval cross-sectional cavity for protection of bulb 20 when that bulb is mounted in the flashlight. Bulb cap 44 is adapted to seat against the inner surface of the bulb base 42 and is retained in position by friction, or adhesives or any other desirable manner. A central opening 50 is in the bulb cap 44 and the lightbulb 20 internal to bulb shield 48 is adapted to project through the central opening 50. Closure cap 46 at the other end of the flexible housing is frictionally retained in place and easily removable, although if desired the closure cap may be adhesively or heat fused in place.

Figure 5:
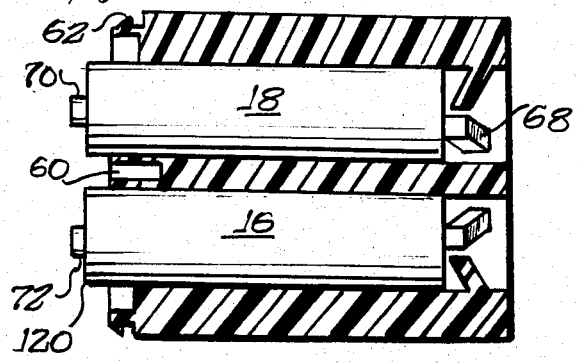
FIG. 5 is a sectional view of the flashlight with the housing omitted and taken along the line of 5—5 of FIG. 4.

The battery retaining case 14 is inside the oval cavity is generally oval in cross-section and is formed of plastic or some other insulating material. The battery retaining case comprises a central body portion 52 with cylindrical battery chambers 54 and 56, outer planar surface 58 and a bulb seat 60 at one end of the central body. The cylindrical battery chambers are elongated cylinders to accommodate batteries 16 and 18 which energize the flashlight. A flange 62 is at the longitudinal end of the battery restraining case bulb base 35. The flange 62 is inward the circumferential edge of the end of the retaining case and terminates as at 64 and 66 such that the flange does not oppose and is not inward the planar surface of the battery retaining case. The flange 62 frictionally engages the opposing bulb base 42 to secure the bulb base with the battery retaining case. As seen in FIG. 5 abutment members 68 retain the batteries in the battery chambers with the positive posts 70 and 72 of the batteries extending forward toward the bulb base.

The lightbulb 20 is conventional and has a reduced diameter tip portion 74 which seats in seat 60 of the retaining case. The bulb has a dome portion 76 which extends through the bulb base into the cylindrical bulb shield 48. The bulb base is frictionally fitted into the bulb cap 44 with the bulb shield extending through a central opening 50 in the center of the bulb cap.

Membrane switch 34 includes a first and second conductor 30 and 32, respectively, bonded onto a flexible substrate insulator strip 36. The conductor may be printed on the flexible insulator strip with the conductor being on the surface or laminated within the flexible substrate insulator strip. As used herein the term printed means layered, printed or print wired or other like process as is known. The conductor may be copper, silver, gold or any other known conductor which may be conveniently printed or overlaid on the substrate. The substrate insulator strip may be plastic, laminated plastic or the like such that the substrate may be resiliently folded and deformed as will be hereinafter described. In a preferred embodiment the substrate insulator strip may be polyethylene terephthalate commonly sold under the tradename of Mylar.

Figure 6:
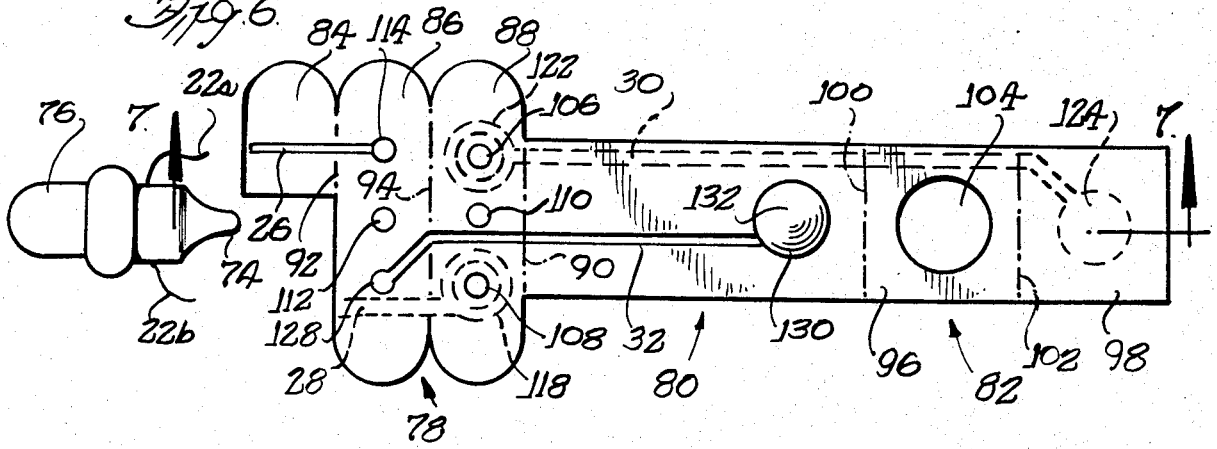
FIG. 6 is a plan view of a membrane switch used in connection with the invention.
Figure 7:
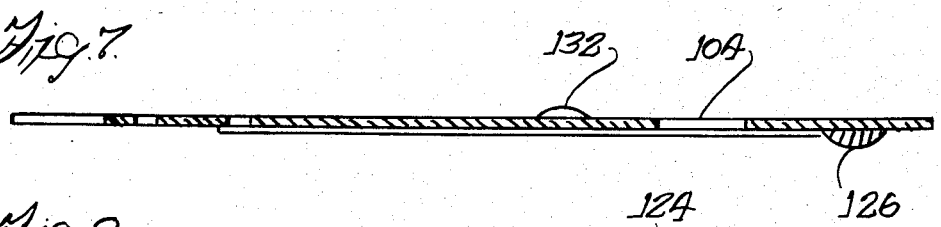
FIG. 7 is a side cross sectional view of the membrane switch taken along the line 7—7 of FIG. 6.

As shown in FIG. 6 the planar flexible substrate insulator strip 36 is divided into a head portion 78, central body 80 and a tail portion 82. The head portion is made up of three fold members, front fold member 84, midfold member 86 and rearfold member 88. The front, midfold and rearfold members of the head portion are separated from the central body 80 by rear fold line 90. Front fold member 84 is about one third of an oval in length and is separated from midfold member 86 by front fold line 92. Midfold member 86 is separated from rearfold member 88 by midfold line 94. The tail portion 82 of the membrane switch includes midsection 96 and switch top 98. The tail section is connected with the central body 80 of the membrane switch by tail fold line 100. The switch top is connected to the midsection 96 of the tail portion of the membrane switch by fold line 102. Both the mid section 96 and switch top 98 are substantially square in shape, the mid section 96 having hole 104 central to the mid section. Each fold line facilitates the resilient folding of the insulator substrate. This is achieved by scoring or reducing the thickness of the insulator substrate along the fold lines.

In the head portion, the rearfold member 88 has conduction holes 106 and 108 and seat access hole 110. The midfold member 86 has seat acesss hole 112 central to oval midfold member, seat acess hole 112 lying along the same longitudinal axis as hole 110 in the rearfold member. Light contact 26 runs linearly from the front fold member 84 across the fold line 92 central to the midfold member 86 terminating in connector abutment 114 for contact with positive terminal 70 of battery 18. As seen in FIG. 6 light contact 28 runs linearly across midfold member 86, across fold line 94 to circular connector abutment 118 for abutting contact with the circular edge of the conductive surface 120 of battery 16. Lead **22*a* of bulb 20 is electrically connected to light contact 26 and lead 22*b* is electrically connected to light contact 28 by pressure fit contact there between without the use of solder. Conductor 30 has circular connector abutment 122 which circularly surrounds conductor hole 106 in rearfold member 88 and linearly runs across rearfold line 90, across central body 80, across tail fold line 100, across midsection 96, across second fold line 102 and terminates in circular top switch 124 having an exposed contact surface 126. Conductor 32 has connector abutment 128 in midfold member 86 linearly runs across fold line 94, across rearfold member 88, across rearfold line 90, across central body portion 80 and terminates in central body switch 130 with exposed contact surface 132**.

Figure 8:
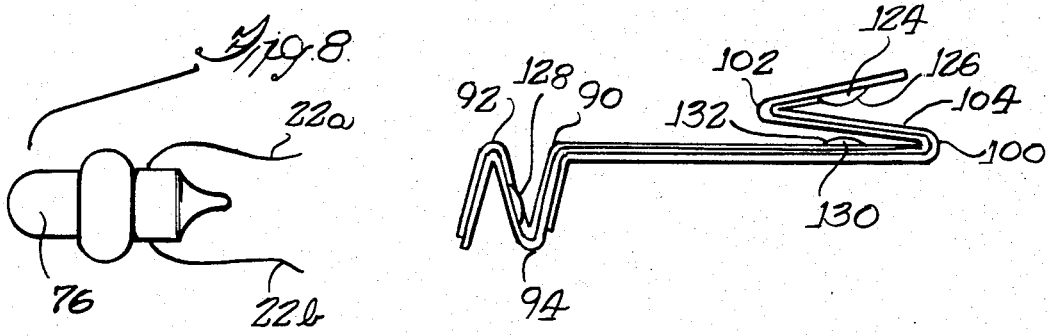
FIG. 8 is a side view of the membrane switch of the invention in conjunction with the bulb of the flashlight.

As shown in FIG. 8, front fold member 84 is folded downwardly along fold line 92 and rearfold member 88 is folded downwardly along rearfold line 90 with midfold member 86 being folded upwardly along midfold line 94. This results in front fold line 92 forming an apex and fold line 94 forming the base of a V such that connector abutments 114 and 128 are aligned with connector holes 106 and 108, respectively.

The tail portion 82 of the membrane switch 34 is folded toward the central body 80 of the membrane switch along tail fold line 100. The switch top 98 of the tail 82 is folded over the midsection 96 of the tail of the switch such that its exposed contact surface 126 is aligned with the exposed contact surface 132 of central body switch 130 through central 104 of mid-section 96.

Figure 9:
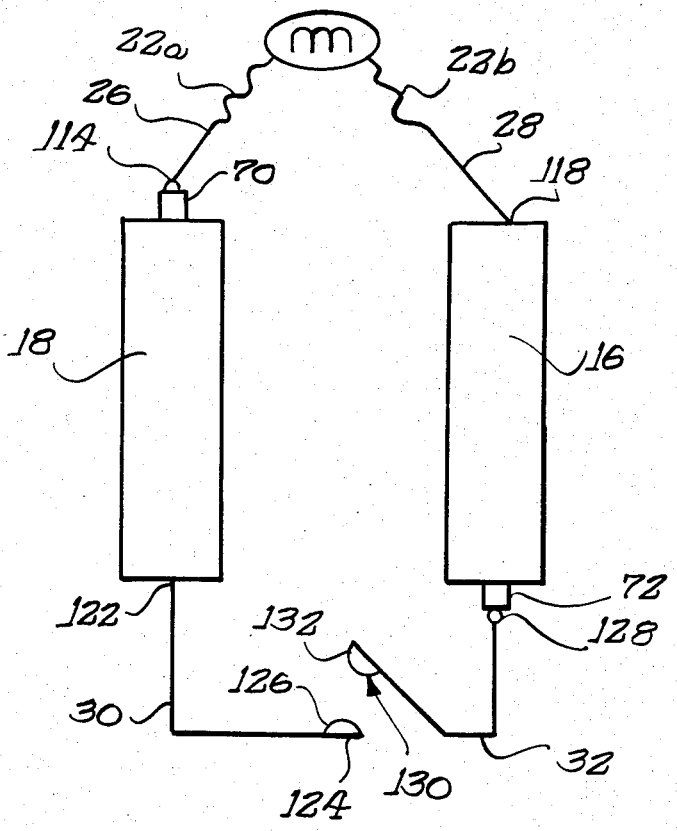
FIG. 9 is a schematic diagram of the arrangement of the bulb, batteries and contact points of the flashlight in the invention.

Hence, in operation the lead **22*a* of the bulb is in contact with light contact 26, connector abutment 114 of light contact 26 extends through connector hole 106 for contact with terminal 70 of battery 18. Circular abutment 122 is in contact with the conductive surface of battery 18, such circular connector abutment extending linearly along conductor 30 terminating in top switch 124. Similarly lead 22*b* of bulb 20 is electrically connected to light contact 28 which terminates in circular connector abutment 118 for abutting contact with the conductive surface of battery 16. Likewise conductor 32 is electrically connected to positive battery terminal 72 of battery 16 through connector abutment 128 which abuts the battery terminal through connector hole 108, conductor 32 terminating in central body switch 130. To complete the circuit and energize the flashlight with batteries 16 and 18, exposed surface 126 of switch top 98 is contacted with exposed contact surface 132 of central body switch 130 through hole 104 as shown in FIG. 8. To facilitate an understanding of the circuit, FIG. 9** schematically illustrates the battery in the circuit of the flashlight.

The light contacts 26 and 28 and conductors 30 and 32 may be on the respective surfaces of the membrane switch or may be stratified within the flexible substrate insulator strip with only contact points on light contacts 26 and 28, circular connector abutments 118 and 122 and the surfaces on top switch 124 and central body switch 130 being exposed for electrical contact and engagement.

When the flashlight is assembled the thin planar central body portion of the membrane switch is laid longitudinally on the planar surface 58 of the battery retaining case. Rearfold line 90 extends over the edge of the end surface of the battery retaining case which opposes the tip 74 of the bulb with rearfold member extending over the circular openings of cylindrical battery chambers 54 and 56. Midfold member is folded upwardly along fold line 94, front fold member is folded downwardly along fold line 92 permitting leads **22*a* and 22*b* to be electrically connected with light contacts 26 and 28**, respectively, as previously described.

The tail portion of the membrane switch is resiliently folded over the central body of the membrane switch, as previously described, such that the planar surface 58 of the battery restraining case forms a base below switch top section 98, central body 80 and central body switch 130. In its assembled form, flexible inner wall 40 and flexible outer housing wall 12 surround the membrane switch battery retaining case such that when it is desired to light the bulb 20, it is merely necessary to squeeze the opposite sides of outer wall member 12 inwardly forward planar surface 58. The force thus exerted moves the inner wall 40 toward the switch top section of the membrane switch. The inner wall engages the switch top section and moves exposed contact surface 126 of top switch 124 toward exposed contact surface 132 of central body switch 130 to contact surfaces 126 and 132 to complete the electrical circuit between light bulb 20 and battery 16 and 18 which energizes the lightbulb. Upon release of the outer flexible housing wall the exposed contact surfaces 126 and 132 resiliently disengage from one another thereby breaking the electrical circuit and shutting the flashlight off.

In accordance with another aspect of the invention, the bulk cap 44 may be injected molded with a reactivatable phosphorescent material therein. The preferred phosphorescent materials are pigments, e.g. zinc sulfide or zinc-cadmium sulphide that are chemically stable and insoluble materials. The bulb 20 will shine directly onto the outer surfaces **44*a* and 44*b* of the bulb cap 44 to reactivate the phosphorescent material. The phosphorescent afterglow may last from 0.5 hour to about 12 hours. Manifestly, the phosphorescent material may be molded into and concentrated at specific areas of the bulb cap 44 rather than integrated uniformly throughout the cap 44**. The preferred molded plastic for the cap is a low density, injection molded plastic.

From the proceeding description of a preferred embodiment it can be seen that a flashlight has been provided with an economical switching mechanism which is economical to manufacture and which requires a minimum amount of or no soldering or an adhesive during manufacturing and/or assembling.

It should be understood that while certain preferred embodiments of the present invention have been illustrated and described, various modifications thereof will become apparent to those skilled in the art, and accordingly, the scope of the present invention should be defined only by the appended claims and equivalents thereof.

Various features of the invention are set forth in the following claims.

What is claimed is:

1. A flashlight comprising a housing having a flexible side wall, adapted to be inwardly and resiliently flexibly deformed to energize and light said flashlight;

a battery retaining case adapted to hold a pair of batteries in spaced relation;

a light bulb having at least two electrical leads for electrical connection with the batteries;

a membrane switch means including a flexible, flat insulator strip between said housing and said retaining case, said membrane switch means including a head portion for connecting the leads of said bulb with said batteries, said membrane switch means including a first and second conductor bonded on said flexible substrate insulator strip, said conductors terminating in a first and second switch contact, said membrane switch means having a resiliently folded portion carrying said switch contacts so that when the housing is flexibly deformed said first and second switch contacts are connected to complete an electrical path through said conductors on said insulator strip means to energize said flashlight.

2. A flashlight as recited in claim 1 wherein said first and second conductors are printed on a plastic sheet.

3. A flashlight as recited in claim 2 wherein said first and second conductors are laminated into said plastic sheet with said first and second switch contact having exposed contact surfaces.

4. A flashlight as recited in claim 1 wherein said first and second conductors include light contacts for electrical connection of said bulb with said batteries, said conductors terminating in a first switch and a second switch each having exposed contact surfaces which are electrically engaged when said housing is resiliently and flexibly deformed causing membrane switch to resiliently fold and electrically engage said exposed contact surfaces and energize and light said flashlight.

5. A flashlight for receiving a pair of batteries having terminal posts comprising a housing having a flexible side wall, adapted to be inwardly and resiliently flexibly deformed to energize and light said flashlight;

a battery retaining case adapted to hold a pair of batteries in spaced relation;

a light bulb having at least two electrical leads for electrical connection with the batteries;

and electrical circuit means for connecting the bulb to the batteries to energize the same;

a flexible insulator substrate in said electrical circuit means between said housing and said retaining case, and having a head portion adjacent said bulb and the location of the battery terminal posts and a second switch contact portion having resiliently spaced sections;

first and second conductors on said flexible insulators substrate for conducting electrical current in said circuit means and extending into said head portion for connecting with said bulb leads and battery terminal posts, and switch contacts on said resiliently spaced sections of said flexible insulator substrate and each connected to one of said conductors and normally spaced from each other by the resiliently spaced sections, said resiliently spaced sections of said insulator substrate being displaced to bring the switch contacts into engagement when the housing is flexibly deformed to energize the bulb.

* * * * *